US008266719B2

(12) United States Patent
Duby

(10) Patent No.: US 8,266,719 B2
(45) Date of Patent: Sep. 18, 2012

(54) STRAPE GLOVE

(76) Inventor: Dante Duby, El Cajon, CA (US)

( * ) Notice: Subject to any disclaimer, the term of this patent is extended or adjusted under 35 U.S.C. 154(b) by 927 days.

(21) Appl. No.: 12/218,299

(22) Filed: Jul. 14, 2008

(65) Prior Publication Data

US 2008/0276341 A1 Nov. 13, 2008

Related U.S. Application Data

(63) Continuation-in-part of application No. 11/681,054, filed on Mar. 1, 2007, now abandoned.

(51) Int. Cl.

| | |
|---|---|
| ***A41D 19/00*** | (2006.01) |
| ***A63B 63/00*** | (2006.01) |
| ***A63B 69/36*** | (2006.01) |
| ***A63B 69/38*** | (2006.01) |

(52) U.S. Cl. ..... 2/161.1; 473/205; 473/212; 473/458; 473/464

(58) Field of Classification Search ..... 2/16, 20, 2/161.1, 163; 224/217–222; 473/205, 458, 473/464, 450, 212, 213; 482/44, 47, 48
See application file for complete search history.

(56) References Cited

U.S. PATENT DOCUMENTS

| | | | | |
|---|---|---|---|---|
| 3,225,984 | A * | 12/1965 | Hyman | 224/258 |
| 3,888,482 | A | 6/1975 | Starrett et al. | |
| 4,751,747 | A | 6/1988 | Banks et al. | |
| 4,796,302 | A | 1/1989 | Davis et al. | |
| 5,188,356 | A | 2/1993 | Furr et al. | |
| 6,783,507 | B1 * | 8/2004 | Fisher | 602/22 |
| 2005/0051583 | A1 * | 3/2005 | Herzog | 224/221 |

* cited by examiner

*Primary Examiner* — Katherine Moran

(57) ABSTRACT

A glove made from narrow strap material. Glove advantages when used with a striking tool: improved control, improved striking force, improved tool head acceleration, improved energy transfer, reduced hand fatigue, improved grip, and reduced vibration shock. It can be configured for 1, 2, 3 or 4 fingers plus the thumb. The glove forms a web between the thumb and fingers. The width of the web and the tightness of fit on the thumb and fingers is controlled by a single pull-tab type of adjustment. The adjustment is secured by a contact friction loop which increases in friction during impact force use. The glove can be worn on a bare hand or over the top of a more conventional type of glove while still providing the same advantages.

15 Claims, 4 Drawing Sheets

FIG 6
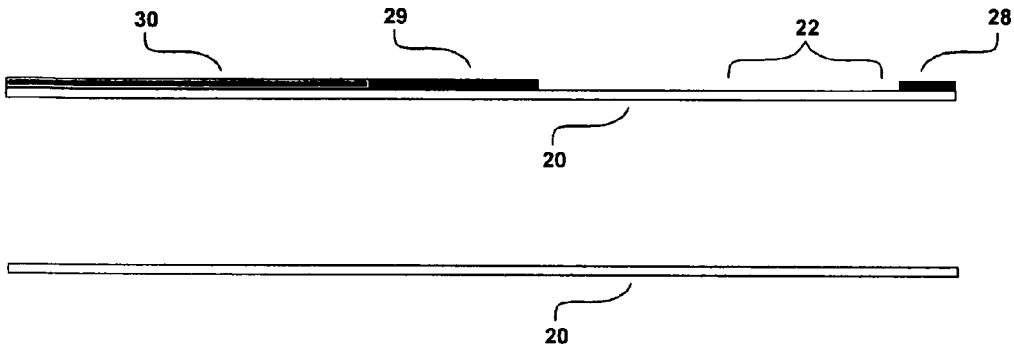
FIG 7
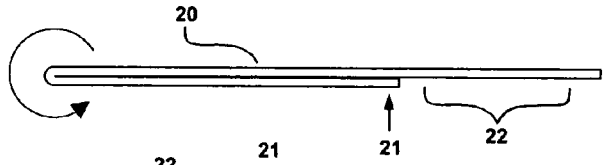
FIG 8
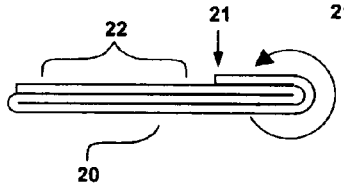
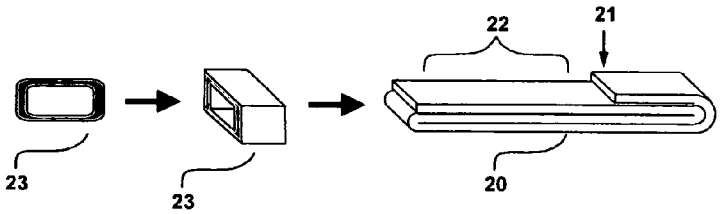
FIG 9
FIG 10
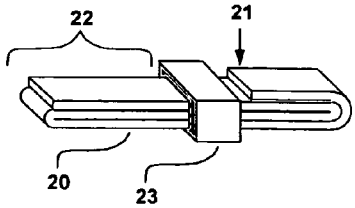

STRAPE GLOVE

This is a continuation in part of application Ser. No. 11/681,054 filed Mar. 1, 2007 now abandoned.

BACKGROUND OF THE INVENTION

The present invention relates to gloves, more specifically to a special type of glove which allows the wearer to transfer greater impact force energy from a striking tool, with a handle, to an object being struck. Generally gloves provide protection for the hand and some may improve grip but virtually none of them are designed to improve mechanical advantage compared with bare handed use. Whereas the present invention is designed specifically for: improved control, improved striking force, improved tool head acceleration, improved energy transfer, reduced hand fatigue, improved grip, and reduced vibration shock.

One object of the present invention is to improve the control of a striking tool such as a baseball bat, hammer, ax, tennis racket, or similar items with handles, by increasing support and stability of the grasped item. The present invention provides a distinct leverage advantage to a person wearing one. Furthermore, the present invention can reduce the force requirements of maintaining the handle of an item from rocking within the hand, thus reducing the muscle strength requirements also. The combination of these advantages results in much greater control of the object being held.

Another object of the present invention is to make it possible for a person wearing it to accelerate the head of a handled tool faster than would otherwise be possible. The present invention accomplishes this by means of the leverage advantage previously stated. Since a person wearing the present invention can exert a force higher up on the handle of a tool, the head of that tool can be accelerated easier. The advantage of this is that with a given amount of force applied, a person wearing the present invention will accelerate a tool head faster than without it causing a higher impact force on an object being struck.

Another object of the present invention is to dampen the vibration shock associated with use of a striking tool during use. This is done by first distributing the shock wave through the length of the strap material and then dampening that wave within the strap material. The effect can be enhanced with the addition of a high vibration dampening material added to the surface area of the strap material that would be in contact with a tool handle. The advantage of this is a reduction in sting that is sometimes felt when a tool is used to strike another object. This is particularly true when the object is not hit squarely or is hit on the wrong part of the instrument being used.

Another object of the present invention is to reduce hand fatigue associated with a repetitive motion when using a tool with a handle. Since the present invention requires less muscle strength to support and stabilize such an instrument, less muscle fatigue will result during repetitive motions. The advantage of this is an increase in the amount of time a tool can be repetitively used before the muscles of the hand start to give out from fatigue.

Another object of the present invention is to improve grip when grasping the handle of a tool. The improved grip results from multiple factors including an increased surface contact area as well as increased friction when the strap is made with or used in combination with a tacky material or substance. The advantage of this is reduced slippage of the item within the hand.

Another object of the present invention is to improve the energy transfer from the muscles of the hand to the handle of a tool being held. The increased energy transfer is a direct result of all of the factors listed above, the improved leverage, improved control, improved tool head acceleration, reduced hand fatigue, and improved grip, as well as a reduction in the ability of an item to rock in the palm of the hand. But in particular, this improvement in energy transfer results from a reduction in the amount of impact force energy absorbed within the muscles, between the thumb and index finger, of the hand. This energy absorption reduction occurs because the strap is made of a non-elastic, non-extendible material that encircles the thumb and at least one finger creating a strap web between them. This strap web deflects very little during use due to its non-elastic nature. Since the handle of a striking tool contacts this strap web when the tool is used to strike another object, the impact force energy, which is equal but opposite to the energy applied to an object being struck, is redirected to the thumb and fingers. Since there is far less energy absorbing muscle tissue on the thumb and fingers than there is between them on the hand, less of the impact force energy will be absorbed. Therefore, more of this energy is transferred into the object being struck. The advantage of this improved energy transfer is a noticeable difference in impact force energy or power transferred from the held item to the item being struck.

These and other objects and advantages of the present invention will become increasingly apparent upon consideration of the drawings and ensuing description.

PRIOR ART

Conventional gloves cover the entire hand at least to the first knuckle of each digit. There is generally no increase in control of a grasped item, with no leverage advantage gained. And, although some gloves can provide for an increased grip with less slippage, they do nothing to improve hand fatigue associated with a repetitive motion. Also, any improvement in energy transfer from the muscles of the hand to the item being held would only be due to a reduction in slippage when the gloves are made to be tackier than a bare hand. Even in cases where padding is added between the thumb and index finger, there is energy lost in that area when the muscles of the hand flex while trying to stabilize a held item.

The most closely related prior art patents to the present invention are slider (U.S. Pat. No. 3,707,730), Starret (U.S. Pat. No. 3,888,482), Banks (U.S. Pat. No. 4,751,747), Furr (U.S. Pat. No. 5,188,356), Davis (U.S. Pat. No. 4,796,302) and Fisher (U.S. Pat. No. 6,783,507).

In the case of the Slider design, a glove which covers the hand with the finger tips exposed has a strap attached to either the thumb or index finger portion of the glove. This strap of material can be attached across the gap between the thumb and index finger with a pressure sensitive means to control the spacing between the two. This design is used to help shape the hand into a cup-like shape for the purpose of holding a basketball with the tips of the fingers and thumb. This type of pressure sensitive attachment/adjustment is not intended to be subject to a great deal of force and therefore will only work for its intended purpose, namely just to reshape the hand. The pressure sensitive attachment/adjustment used in the Slider design would not function properly for the purposes expressed in the present invention. This type of arrangement was tested and verified to fail when a handled tool is subjected to great force, specifically when the tool is used to strike another object. This includes tests with hammers, axes, baseball bats and the like when these tools are used for their intended purposes. The pressure sensitive attachment/adjustment was shown to break free with each impact of these types of tools. Therefore, no usable leverage advantage was gained.

The present invention uses a force friction or contact friction adjustment loop to maintain the gap spacing between the thumb and fingers, which actually increases in contact friction when a handled tool is used for striking another object. This type of adjustment does not break free during force impacts. Therefore, the present invention does provide a significant leverage advantage to anyone wearing it. A pressure sensitive means can be added to enhance such an adjustment since it will help maintain the adjustment for repeatability when the glove is removed and worn again later, but it is not necessary for function.

Additionally, the slider design attaches and distributes the little impact force it can withstand through a single finger and thumb, whereas the present invention distributes a great deal more impact force through 1, 2, 3 or 4 fingers and thumb depending on the configuration setting. Also, the contact force friction loop used in the present invention can be made thicker than necessary so that greater contacting tension force would exist at the point of contact with a tool handle. This increased tension at the point of contact will increase the leverage advantage even further.

Therefore, although the Slider design has some slight similarity to the present invention due to the strap between the thumb and finger, it has been shown not to be a functional design for the intended purpose of resisting a high impact force when using a handled tool to strike another object.

In the Starret design and elastic strap is used to encircle the thumb and one finger. This elastic section is then attached to a wrist band with another elastic strap for the purpose of training a young athlete to throw a baseball. The Starret design could never function for the purpose of the present invention for at least a couple of reasons. First, the elastic material could not resist an impact force applied to a handled tool when striking another object. In order to transfer as much energy as possible to the handle of a string tool, the material between the thumb and fingers must be non-elastic. Elastic material absorbs all the energy by deflecting the handle into the palm and therefore transfers no more energy than wearing no glove at all. Second, the strap that connects to the wrist pulls down the strap web area between the thumb and fingers which effectively eliminates any leverage advantage that could otherwise have been gained.

The present invention however, transfers significantly more energy directly from the fingers and thumb to the handle of a tool through the non-elastic strap web that contacts it. This same contact point provides a significant leverage advantage to anyone wearing the present invention. This effect is enhanced further by the thickness of the contact friction loop used to hold the present invention together.

The Banks design provides thermal protection to two fingers and the thumb of a beautician while using a heated hair curling iron. It does not provide any leverage advantage between the thumb and fingers and it is also made of an elastic material which has already been shown to be ineffective for the purpose of the present invention. Additionally the banks design is intended only for a thumb and two fingers. Whereas, the present invention uses a non-elastic strap web between the thumb and fingers, which gives the wearer a distinct leverage advantage over wearing nothing at all. This effect is enhanced even further by the contact force friction loop holding the present invention together. And, the present invention provides the capability to configure it for 1, 2, 3 or 4 fingers plus the thumb.

The Davis design consists of a pair of sheaths pivotally hinged towards each other with depressions on the inner sides to grip a nail allowing a person to hammer a nail with the sheaths cushioning the blows of the hammer. This type of design could never function in place of the present invention for at least a few reasons. First, the sheath/hinge arrangement does not allow a person to grasp an object with a handle, or rather grasp it with any ability to control it. Second, because the sheath materials must be fairly rigid to protect the finger and thumb from the hammer blows, tool use would be difficult. Long sheaths would prevent the fingers and thumb from being able to wrap around and object handle for control, and short sheaths would put the hinge too high up between the thumb and finger to hold a handled tool. Also, the design does not appear to be adjustable for different finger and thumb sizes, only allows for a single finger and thumb, and provides no additional gripping ability.

The present invention uses a flexible yet non-elastic, non-extendable strap material constructed in such a way as to provide the wearer with the ability to use it with 1, 2, 3 or 4 fingers plus the thumb, and can adjust the fit on them while also adjusting the length of the strap web between them. Additionally the present invention increases the control one has when using a handled striking tool and gives the wearer a distinct leverage advantage over wearing nothing at all.

The Furr design is a strap of material with a loop at one end that fits over the thumb, or a finger. It then wraps around the outside of the thumb, of the weak hand of a basketball player, and then wraps around the players wrist for the purpose of restraining the thumb from lateral movement to improve shooting accuracy. It cannot be used for the purpose of the present invention because a hand wrapped in this way is not intended to grasp a tool with a handle and would show no positive improvement in leverage advantage. If the loop is on the thumb, there is no contact of the strap and the handle of the tool and therefore no leverage advantage what so ever. If the loop is on the finger, with the strap wrapping around the thumb, any impact forces would be absorbed through the strap at its anchor point on the wrist, possibly causing wrist injury, but providing very little leverage advantage because of the long length of the strap.

The present invention also uses a non-elastic strap material and prevents lateral movement of the thumb when the glove is worn, but the short span of material that extends between the thumb and fingers distributes the impact forces of the handled tool to the thumb and fingers so that there is a definite leverage advantage and a substantial energy transfer. The effect is also enhanced by the thickness of the contact friction loop holding the glove together.

The Fisher design is a thumb splint made from a strap of material that wraps around the thumb, index finger and wrist. It is intended to prevent abduction of the thumb. The strap attaches to the wrist so that the material between the thumb and index finger can be pulled downward allowing the splint to be worn underneath a glove without restricting movement other than thumb abduction. Because the web area between the thumb and index finger is pulled down, there would be no leverage advantage when holding an object with a handle. Therefore, no difference in energy transfer or any improvement in tool control would result from its use.

In the present invention, the material that spans between the thumb and fingers is not pulled down as it directly affects the amount of leverage that can be applied to the handle of the tool in use. In fact, this strap web area is increased in thickness and effectiveness in the present invention by the added contact friction loop that holds the present invention together, thereby increasing the leverage advantage even further. The present invention is also intended to be worn over a conventional glove, not under one.

SUMMARY OF THE INVENTION

A glove that improves control and striking force of a handled tool such as a hammer, ax, baseball bat, or the like by improving the leverage and support of such an item when held. In addition to the improved control and striking force, the glove also improves tool head acceleration, energy transfer, and grip, while reducing hand fatigue and vibration shock.

The glove is formed by looping a narrow strap of material back onto itself and attaching it. That loop is then folded and a contact friction loop is slipped over the top to form three separate finger/thumb holes. This is the standard configuration of the glove which then fits two fingers and the thumb. The glove size can be changed by pulling on an adjustment tab that passes through the contact friction loop. The effect of pulling on the adjustment tab is a tightening on the fingers and the thumb as well as adjusting the span between them to accommodate different handle thicknesses and hand sizes. The contact friction loop increases in resistance when a handled tool is used to strike another object thus improving the hold on the adjustment. The adjustment feature can be enhanced further by the addition of a pressure sensitive means since it can help maintain the adjustment for repeatability when the glove is removed and worn again later. The grip and vibration dampening properties of the glove can be enhanced by adding a high coefficient of friction material with high vibration dampening properties to the outer surfaces of the strap and contact friction loop.

The glove can also be configured to form one small and one large finger hole area such that two or more fingers can be inserted into the larger finger hole with one finger in the smaller hole so that 3 or 4 fingers total plus the thumb could be inserted into the glove. The glove can also be configured so that only one finger hole and the thumb hole are indicated. The glove can be worn over a bare hand or over the top of a conventional glove.

DESCRIPTION OF THE DRAWINGS

FIG. 6 shows the narrow strap material with and without additional materials.

FIG. 7-FIG. 10 shows the sequence of folds required for make the glove.

DETAILED DESCRIPTION OF THE PREFERRED EMBODIMENT

Figure 1:
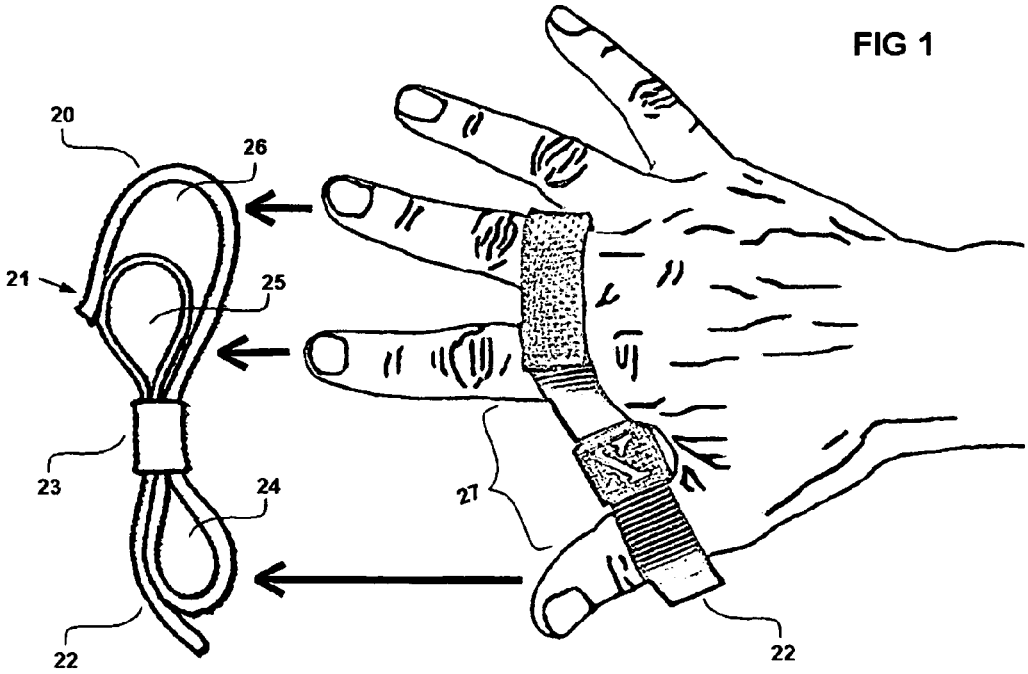
FIG. 1 shows a side view and functional view of the most common configuration of the glove encircling the thumb and two fingers.
Figure 4:
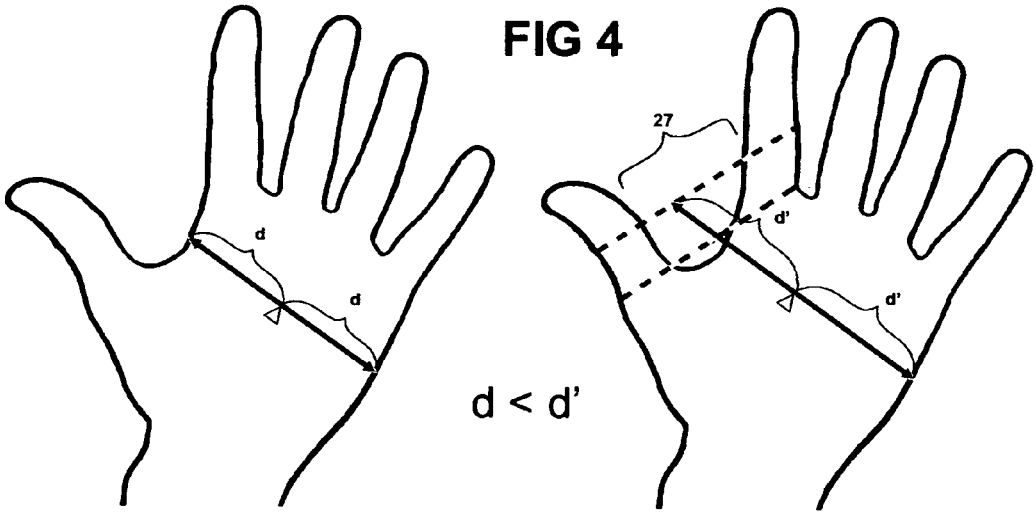
FIG. 4 shows the effective palm width leverage advantage using the glove.

Referring to the drawings for a more detailed explanation of the preferred form of the invention, FIG. 1 shows the most common configuration of the glove both from the side view and a functional view. This is called the standard two finger configuration since two fingers and a thumb are used. Most people with normal size hands and fingers will find this configuration to be the most comfortable. In the side view significant areas of the glove are listed. The narrow strap material, 20, is folded (as indicated in FIG. 7-FIG. 10), attached to itself at point 21, and held together with the contact friction loop 23. This forms the glove with three distinct loops, the thumb hole 24, first finger hole 25 and second finger hole 26. The pull-tab adjustment 22 is used to control the span between the thumb and fingers, known as the strap web 27, for accommodating different tool handle thicknesses, and also to adjust the size of all three holes to accommodate different hand and finger sizes. The functional view shows the glove being worn on a bare hand. This type of glove can also be worn over the top of a conventional glove. In addition, the functional view shows the position of the strap web 27, and the pull-tab adjustment 23. The strap web 27, increases control and striking force when using a handled tool such as a hammer, baseball bat, ax, tennis racket, or similar items with handles. It does this because of a leverage advantage that is achieved while wearing the glove as indicated in FIG. 4.

In the optimum form of the invention, the glove is either made with or has a material or substance with high coefficient of friction and high vibration dampening properties added to the surface of the narrow strap material that will be in contact with a tool in use to enhance grip and reduce vibration shock. This same material is then used on the outer surface of the contact friction loop. Additionally, a pressure sensitive adhesive can be added between the underside of the pull-tab 22 and the outside of the thumb loop to enhance the adjustment feature. Both of these enhancements are in the functional view although the pressure sensitive adhesive cannot be seen as it is under the pull-tab. For placement information of these enhancements see FIG. 6. These enhancements are not necessary for all applications.

Figure 2:
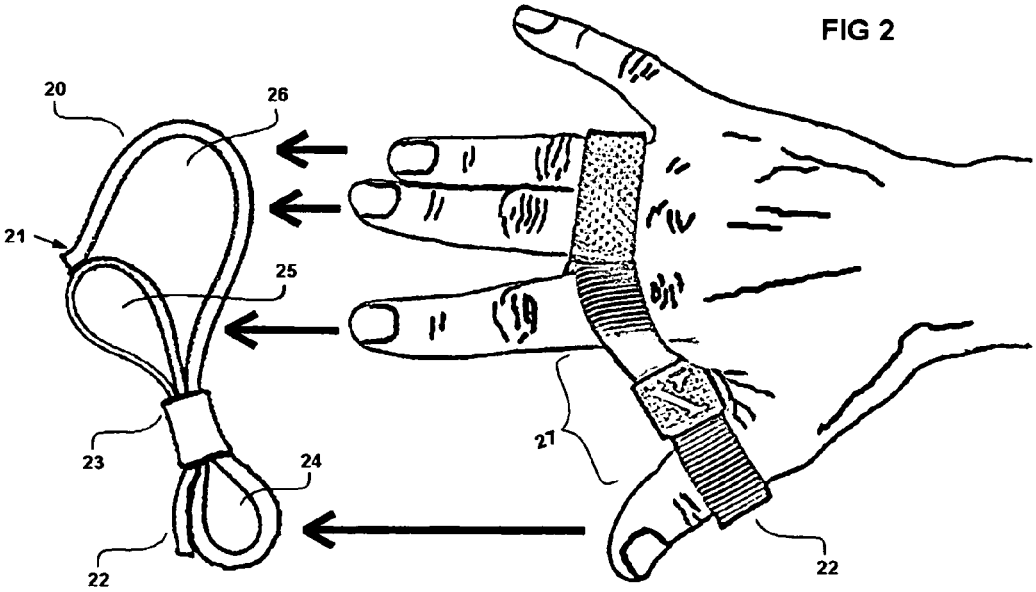
FIG. 2 shows a side view and functional view of an alternative configuration of the glove encircling the thumb and three fingers.

FIG. 2 shows the same views as in FIG. 1 except that an alternative glove setting configuration is used in which the second finger hole 26 is pulled and adjusted to make it wider so that two fingers could fit through that one hole. This is called the three finger configuration because three fingers plus the thumb are used. If the second finger hole 26 is made even larger, then all 4 fingers will fit though it creating a four finger configuration. Someone with smaller hands or thinner fingers may prefer these configurations.

Figure 3:
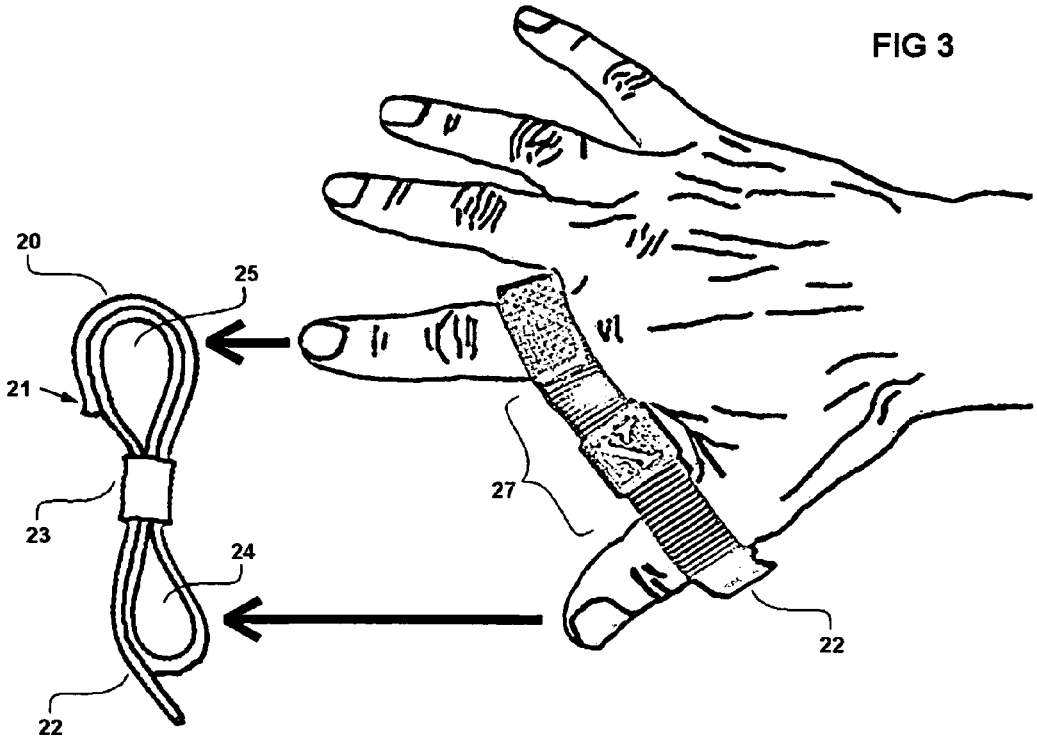
FIG. 3 shows a side view and functional view of an alternative configuration of the glove encircling the thumb and one finger.

FIG. 3 shows the same views as in FIG. 1 except that an alternative glove setting configuration is used in which the first finger hole 25 is pulled and expanded to fill the area normally occupied by the second finger hole 26 (as seen in the previous drawings). This is called the one finger configuration because one finger plus the thumb are used. Someone with larger hands or thicker fingers may prefer this configuration.

The function of the glove in all configurations remains the same, that is to increase the control and striking force of a hand held tool or item with a handle such as a hammer, baseball bat, ax, or similar items when those items are used to do impact force type of work. That is, when they are used for their intended purpose, to strike another object.

Referring to FIG. 4, for a more technical reason of why a glove such as that described by the present invention can have such an effect on tool control and striking force; there is an empty hand on the left and a hand on the right that shows dashed lines indicating the location of where the strap web 27 normally occurs when the present invention is being worn. At the effective center of each palm is a small triangle that indicates the fulcrum point, or pivot point within the hand about which a held item will try to rotate. This pivot point is determined by finding the contact points on the palm that will exert the most force in controlling a held item in use, namely the edges of the palm, and dividing that distance in half (finding their center). Note how in the hand on the right this pivot point has shifted slightly toward the strap web area 27. This occurs because in the case of the hand wearing the present invention one of the points of maximum force exerted on the held item is the edge of the strap web 27 which contacts the handle of the item being held; and the other maximum force contact point is on the other side of the palm. In the case of the empty hand both sides of the palm are the maximum force points used. Since the distance between these two points is longer in the hand wearing the present invention, when you divide that distance in half, the force lever d' in the hand wearing the present invention will be longer than the force lever d in the empty hand. This is significant because the standard equation for torque states, that torque is equal to the applied force multiplied by the distance from the axis of rotation. And, in this case the force levers d and d' represent the distance from the axis of rotation (pivot point). Therefore, the longer the levers d or d', the less force is required at the maximum force points (edges of the palm) to resist the rocking of a tool in use. This means a hand wearing the present invention requires less force to keep a held item from rocking. Or stated another way, for the same given amount of force applied, a hand wearing the present invention will exert a greater controlling force to an item being held than a hand not wearing the present invention, due to the increase in torque leverage. Therefore, a person wearing the present invention can either do a job with less effort, or for the same level of effort, finish the job in less time.

Figure 5:
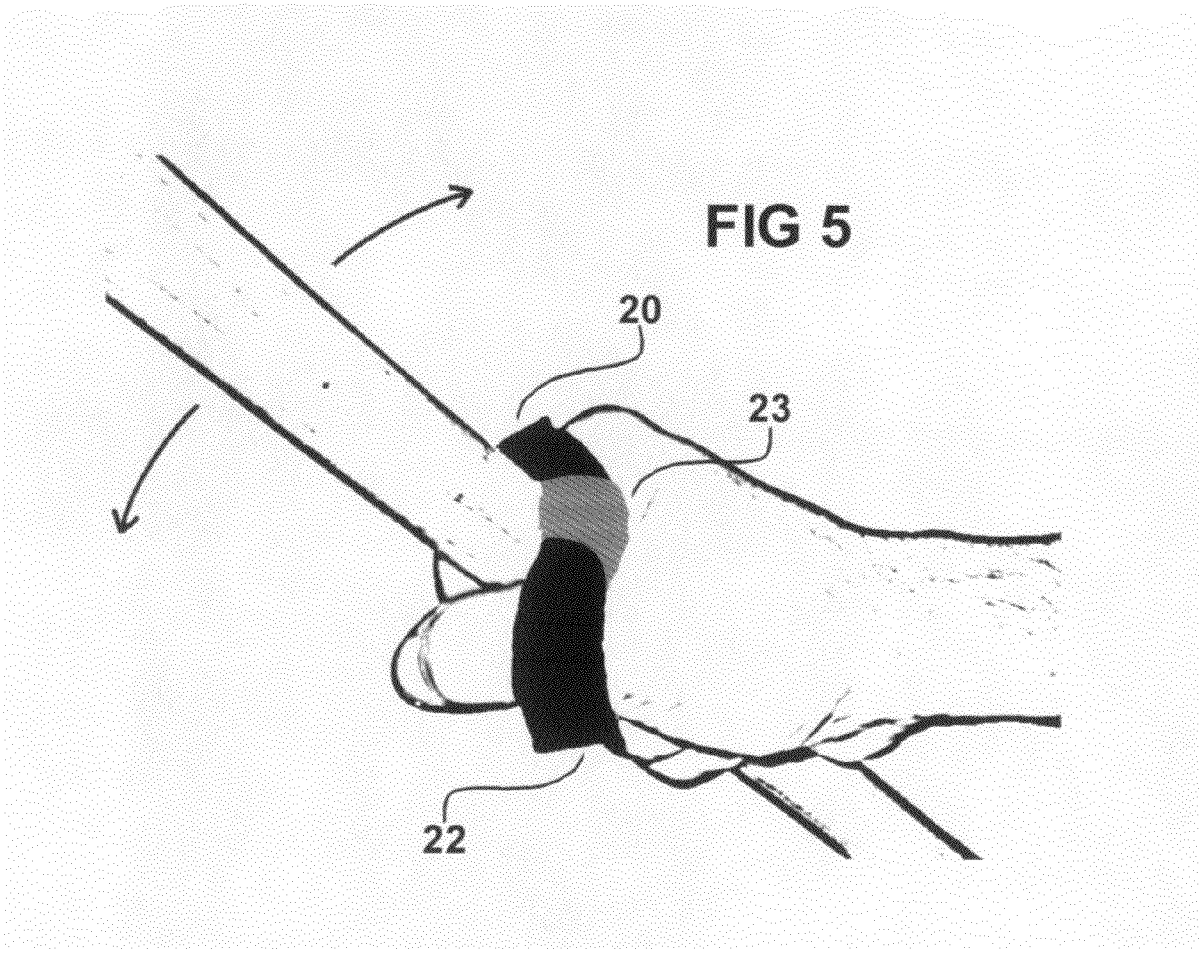
FIG. 5 shows the glove in use with a striking tool.

FIG. 5 shows the glove in use while holding an item. This item can be a baseball bat, hammer, or anything similar that requires the hand to resist the rocking motion of the item in use. Without wearing the glove, the muscles between the thumb and index finger are in direct contact with the rocking item and will flex, particularly when the item is used to strike something else. When this occurs, some of the energy applied to the item is lost in the muscle tissue. The muscles act somewhat like a shock absorber in this respect. However, when the present invention is worn, the amount of muscle tissue surrounding the fingers and thumb is significantly less than that of the muscle tissue between the thumb and index finger and therefore the amount of flex that can occur is significantly less also. The result of less flexing is less energy absorption and therefore more energy is transferred to the item being held.

FIG. 6 shows side views of the narrow strap material 20 by itself in the lower portion of the figure and with additional materials added onto it in the upper part of the figure. Some of the features of the present invention can be enhanced by the addition of these materials. Specifically, the grip of the strap and the vibration shock dampening can be enhanced with the use of a high coefficient of friction material with high vibration dampening properties, 30 added onto the strap so that it contacts the handle of the tool being held. Also, the adjustment of the present invention becomes more semi-permanent with the addition of a pressure sensitive adhesive such as hook and loop 28 & 29. The area of the strap that will function as the adjustment pull-tab is 22.

FIG. 7-FIG. 10 shows the folding operation used in making the present invention. FIG. 7 shows a side view of the bare strap material of FIG. 6 folded down on the left side until it swings back up and contacts itself. It is then permanently tacked at the location indicted by 21. This permanent tacking may be done by sewing or any other permanent means. This forms a large loop that would be visible if the strap was pulled open. Also the fold is short enough to leave a portion of the material outside this inner loop, 22, and this will be the adjustment pull-tab. FIG. 8 shows a side view of the folded loop section folded once again onto itself, but not permanently tacked. Instead, in FIG. 9 a perspective view shows the contact friction loop 23 inserted over the top of the folds to hold the glove together. FIG. 10 shows a perspective view of the completed assembly. If the loops were opened in FIG. 10 the glove would look like the side view in FIG. 3, with only a single thumb and finger hole. It was shown this way for simplicity, however, in practice with only a slight adjustment to the folded loops during the application of the contact friction loop the standard three hole configuration of FIG. 1 would result.

The operational use of a strap-glove is fairly straight forward. The user first slips the glove over a thumb and at least one finger depending on the number of finger holes. The glove can also be used over a conventional glove simply by adjusting for larger finger and thumb thickness. Then the item to be used is grasped and the strap web width is adjusted by pulling on an adjustment tab. In this way different thickness handles can be accounted for while ensuring a snug fit. Alternatively, the adjustment can be made before grasping the handle of the item. If a pressure sensitive adhesive enhancement was included in the glove the pull-tab which would have this adhesive on its underside would be pushed down onto the outer portion of the thumb loop which would have the corresponding adhesive located there. This would help ensure the glove adjustment setting will stay in that position from one usage to the next.

Since the present invention improves tool control, tool head acceleration, grip, energy transfer, and striking force while reducing muscle fatigue, and vibration shock, a certain degree of performance improvement could be expected in some sports as well. One example would be when using the glove for batting in baseball; since more energy is transferred to the bat, more energy will in turn be transferred to the ball when struck with the bat. Therefore the ball should carry farther as well. The improvement in control should also improve a players batting average.

For construction use, the improved striking force and energy transfer should lessen the time required to complete a task with any striking tool. The reduction in muscle fatigue should make it possible to work longer hours at the same task. And, the improved tool control should increase safety and productivity. The improved grip and reduced vibration shock should lessen injury.

I claim:

1. A glove comprising:

(a) a thumb receiving section, (b) at least one finger receiving section, (c) a strap web section, (d) a contact friction retaining loop, (e) a draw-strap adjustment means, (f) a strap means, (g) where a first section of said strap means encircles the proximal phalanx of a wearers thumb to form said thumb receiving section, (h) where a second section of the strap means extends from said thumb receiving section and encircles the proximal phalanx of a wearers finger to form said finger receiving section, (i) said strap web section located along said second section of said strap means between the thumb and finger receiving sections, and having a length substantially equal to the distance between them, (j) said strap web section being formed of a portion of the second section of the strap means which spans the length thereof, (k) where the strop web section is encircled by said contact friction retaining loop about the strap web section's length substantially in the middle thereof, (l) said contact friction retaining loop configured essentially of rectangular shape such that the length of its major axis determines a width of the strap web section, (m) said width of the strap web section determining a length of a virtual lever that exists between the center of a wearers palm and the furthest edge of the strap web section away from the wearers palm between the wearers thumb and fingers, (n) said virtual lever thereby providing means for increasing the torque leverage advantage of a wearer wearing the glove while using any handled tool, based on the mathematical equation for torque, (o) said draw-strap adjustment means communicating through the contact friction retaining loop and forming a means to alter the length of the strap web section, by effectively removing some of the strap means material therefrom as the draw-strap is pulled, thereby providing means for adjustment for the glove, and (p) said contact friction retaining loop increasing in its frictional resistance when the glove is worn by a wearer during a gripping of a handled tool to strike an object, thereby providing means for retaining glove adjustment under high impact force loading conditions.

2. The glove of claim 1 and further including that said draw-strap adjustment means further provides said means to alter the length of said strap web section and means to alter the circumferences of said thumb receiving section and said finger receiving section concurrently, by a pulling of the draw-strap though the friction retaining loop, thereby providing adjustment for all of the glove sections simultaneously, where the circumferences of the thumb and finger receiving sections, though adjusted simultaneously, will acquire separate dimensions after adjustment, dependent on the thicknesses of a wearers thumb and fingers.

3. The glove of claim 2 and further including that said at least one finger receiving section is a plurality of finger receiving sections where said strap means encircles the proximal phalanxes of a wearers fingers in said plurality of finger receiving sections and where said strap web section is located between said thumb receiving section and the plurality of finger receiving sections and said web section has a length substantially equal to the distance between the thumb receiving section and the nearest finger receiving section.

4. The glove of claim 3 wherein both said contact friction retaining loop and said strap means are single elements that together form the glove, wherein said draw-strap adjustment means, with said means to alter the length of said strap web section and said means to alter the circumferences of said thumb receiving section and said plurality of finger receiving sections, constitutes a portion of the strap means, and said strap web section is formed by the contact friction retaining loop engaged upon a small section of the portion of the strap means which extends between the thumb receiving section and the plurality of finger receiving sections.

5. The glove of claim 3 and further including that said plurality of finger receiving sections be concentric, that is, one inside a perimeter of another.

6. The glove of claim 5 and further including that said draw-strap adjustment means have an inner surface that faces a wearers hand, where said inner surface of the draw-strap has a pressure sensitive means attached thereto and where said thumb receiving section also has a pressure sensitive means attached thereto and where the draw-strap extends out of said contact friction retaining loop on the side closest the thumb receiving section where said pressure sensitive means on the inner surface of the draw-strap can be biased against said pressure sensitive means on the thumb receiving section to form an engagement to hold the draw-strap adjustment in place after adjustments have been made to the glove to fit a wearers hand.

7. The glove of claim 6 and further including an outer surface facing away from a wearers hand where said outer surface of the glove has a vibration dampening means, with high coefficient of friction, attached thereto.

8. The glove of claim 5 wherein both said contact friction retaining loop and said strap means are single elements that together form the glove, wherein said draw-strap adjustment means, with said means to alter the length of said strap web section and said means to alter the circumferences of said thumb receiving section and said plurality of finger receiving sections, constitutes a portion of the strap means, and said strap web section is formed by the contact friction retaining loop engaged upon a small section of the portion of the strap means which extends between the thumb receiving section and the Plurality of finger receiving sections.

9. The glove of claim 2 and further including that said draw-strap adjustment means have an inner surface that faces a wearers hand having a pressure sensitive means attached thereto, said thumb receiving section having an outer surface that faces away from a wearers thumb having a pressure sensitive means attached thereto with the draw-strap adjustment means extending out of said contact friction retaining loop on the side closest the thumb receiving section where said pressure sensitive means on the inner surface of the draw-strap can be pressed against said pressure sensitive means on said outer surface of the thumb receiving section to hold the draw-strap adjustment in place after adjustments have been made to the glove to fit a wearers hand.

10. The glove of claim 2 and further including an outer surface facing away from a wearers hand where said outer surface of the glove has a vibration dampening means, with high coefficient of friction, attached thereto.

11. The glove of claim 1 wherein the glove is incorporated into the structure of a conventional glove, such that said thumb receiving section incorporates into the structure of a thumb cover of said conventional clove and said finger receiving sections incorporate into the structure of finger covers of said conventional glove, where the conventional glove is constructed with a palm covering extending to said thumb cover and said finger covers, which when worn, covers at least the first phalanxes of a wearers thumb and fingers, and a majority of the wearers hand.

12. A glove which increases both the striking force achievable with, and the ability to control, a handled tool by a wearer comprising:

(a) a narrow strap material having a first end and a second end, (b) a contact friction retaining loop, (c) a strap web section, (d) a thumb receiving section, (e) a first finger receiving section, (f) a second finger receiving section, and (g) a draw-strap adjuster, (h) said narrow strap material is flexible non-elastic non-extendable, (i) said contact friction retaining loop is a flexible single element, (j) an attachment at said first end of the narrow strap material providing a permanent engagement of a first fold at a point within the length of the narrow strap material, and defining a main loop, said main loop including a section of the narrow strap material, which includes said second end of the narrow strap material extending therefrom, (k) said section of the narrow strap material defining said draw-strap adjuster, (l) said main loop having a second fold back onto itself such that both said first end and said second end of the narrow strap material face outward of said second fold, (m) said narrow strap material having the second fold of the main loop and the draw-strap adjuster defining a main structure for the glove, (n) the contact friction retaining loop engaged over said main structure for the glove substantially at a middle thereof, thereby holding the glove operatively engaged, with the draw-strap adjuster extending outward therefrom, (o) whereby three distinct loops are formed, (p) a first loop formed on one side of the contact friction retaining loop and second and third loops formed on an opposite side of the contact friction retaining loop, (q) said first loop defining said thumb receiving section, (r) said second loop defining said first finger receiving section, (s) said third loop defining said second finger receiving section, (t) the second loop positioned within the third loop thereby positioning the first finger receiving section within the second finger receiving section, (u) said strap web section communicating a distance between the thumb receiving section, and the finger receiving sections, (v) the strap web section's width configured substantially equal to a distance twice a thickness of the contact friction retaining loop plus the width of the narrow strap material, (w) a pulling on the draw-strap providing means to alter, the length of the strap web section, and the circumferences of the thumb receiving section, and both finger receiving sections, by drawing out a segment of the narrow strap material from all sections of the glove, thereby providing an adjustment for the glove, wherein the thumb and finger receiving sections during said adjustment may interdependently achieve respective different circumferences depending on the size of a wearers thumb and fingers.

13. The glove of claim 12 further comprising, said draw-strap adjuster having an inner surface that faces a wearers hand during a wearing of said glove, said inner surface of the draw-strap having a pressure sensitive means attached thereto and said thumb receiving section also having a pressure sensitive means attached thereto and where the draw-strap extends from said contact friction retaining loop on a side closest the thumb receiving section, and said pressure sensitive means on the inner surface of the draw-strap biasable against said pressure sensitive means on the thumb receiving section, to form a means to hold the draw-strap adjustment in place after adjustments have been made to the glove to fit a wearers hand.

14. The glove of claim 13 further including said glove having an outer surface facing away from a wearers hand, said outer surface of the glove having a vibration dampening means thereon having a high coefficient of friction.

15. A strap glove comprising:

(a) a thumb receiving section, (b) a plurality of finger receiving sections which are concentric about one another, with an outermost finger section and an innermost finger section, (c) a strap web section, (d) a contact friction retaining loop, (e) a draw-strap adjustment means, and (f) a strap means which is flexible and non-expandable, (g) said strap means configured to encircles the proximal phalanx of a wearers thumb to form said thumb receiving section, (h) said strap means configured to encircles the proximal phalanxes of a wearers fingers to form said plurality of finger receiving sections, (i) said strap web section is located upon a section of said draw strap communicating between the thumb and finger receiving sections, said strap web section having a length substantially equal to a distance between the thumb receiving section and said outermost finger receiving section, (j) said strap means forming an inner structure of the strap web section and spanning the length thereof;

(k) said inner structure of the strap web section is encircled in an engagement by said contact friction retaining loop positioned along the length of said strap web sections substantially at a middle thereof, (l) where the contact friction retaining loop is essentially of rectangular shape such that the length of its major axis determines a width of the strap web section, (m) said width of the strap web section determining a length of a virtual lever positioned between a center of a wearers palm wearing said strap glove, and a furthest edge of the strap web section positioned away from the wearers palm between the wearers thumb and fingers, (n) said virtual lever providing means to increase the torque leverage advantage of a wearer wearing the strap glove while gripping and using any handled tool, based on the mathematical equation for torque, (o) a pulling of said draw-strap adjustment means communicating through the contact friction retaining loop, providing an alteration of the length of the strap web section and resulting adjustments in respective circumferences of the thumb and finger receiving sections simultaneously, (p) said circumferences of the thumb and finger receiving sections, though adjusted simultaneously, acquiring separate respective dimensions after adjustment, dependent on the thicknesses of a wearers thumb and fingers, (q) said contact friction retaining loop providing an increase in frictional resistance when the strap glove is worn by a wearer and used during a gripping of a handled tool to strike an object, thereby providing means for retaining strap glove adjustment under high impact force loading conditions, (r) said draw-strap adjustment means having an inner surface facing a wearers hand, s) said inner surface of the draw-strap having a pressure sensitive means attached thereto and the thumb receiving section also having a pressure sensitive means attached thereto, and said draw-strap extending out of the contact friction retaining loop on a side closest the thumb receiving section, said pressure sensitive means on the inner surface of the draw-strap biasable against said pressure sensitive means on the thumb receiving section to form an engagement to hold the draw-strap adjustment in place after adjustments have been made to the strap glove to fit a wearers hand, (t) said strap glove having an outer surface facing away from a wearers hand, said outer surface of the strap glove having a vibration dampening means thereon having high coefficient of friction, and (u) both the contact friction retaining loop and the strap means being single elements that together form the strap glove, wherein said draw-strap adjustment means constitutes a portion of the strap means and said strap web section formed by the contact friction retaining loop engaged upon a small portion of the strap means communicating between the thumb receiving section, and said plurality of finger receiving sections.

* * * * *